US005593705A

United States Patent [19]

Schilo et al.

[11] Patent Number: 5,593,705

[45] Date of Patent: Jan. 14, 1997

[54] APPARATUS FOR MELT SPINNING MULTIFILAMENT YARNS

[75] Inventors: Diederich Schilo, Klingenberg; Wolfgang Peschke, Obernburg, both of Germany

[73] Assignee: Akzo Nobel NV, Arhem, Netherlands

[21] Appl. No.: 205,744

[22] Filed: Mar. 4, 1994

[30] Foreign Application Priority Data

Mar. 5, 1993 [DE] Germany ..... 43 06 925.8

[51] Int. Cl.[6] ..... B29C 47/88; D01D 5/088

[52] U.S. Cl. ..... 425/72.2; 264/177.19; 264/211.12; 264/211.14; 264/237; 425/378.2; 425/382.2; 425/464

[58] Field of Search ..... 425/72.2, 378.2, 425/382.2, 464; 264/211.14, 177.17, 177.19, 237, 211.12

[56] References Cited

U.S. PATENT DOCUMENTS

| | | | |
|---|---|---|---|
| 2,252,684 | 8/1941 | Babcock . | |
| 3,067,458 | 12/1962 | Dauchert . | |
| 3,611,485 | 10/1971 | Leybourne et al. | 425/445 |
| 4,195,051 | 3/1980 | Frankfort et al. | 264/211.1 |
| 4,568,506 | 2/1986 | Kirayama et al. | 264/211.1 |
| 4,702,871 | 10/1987 | Hasegawa et al. | 264/211.1 |
| 4,712,988 | 12/1987 | Broaddus et al. | 425/72.2 |
| 4,943,220 | 7/1990 | Fourne | 425/72.2 |
| 5,034,182 | 7/1991 | Sze et al. | 264/211.1 |
| 5,141,700 | 8/1992 | Sze | 264/211.1 |
| 5,219,582 | 6/1993 | Anderson et al. | 425/378.2 |
| 5,234,327 | 8/1993 | Martin | 264/211.1 |
| 5,340,517 | 8/1994 | Koschinek et al. | 425/72.2 |
| 5,360,589 | 11/1994 | Wandel et al. | 425/72.2 |

FOREIGN PATENT DOCUMENTS

| | | | |
|---|---|---|---|
| 0056963 | 8/1982 | European Pat. Off. . | |
| 0095712 | 12/1983 | European Pat. Off. . | |
| 0117215 | 8/1984 | European Pat. Off. . | |
| 0244216 | 11/1987 | European Pat. Off. . | |
| 0455897 | 11/1991 | European Pat. Off. . | |
| 0580977 | 2/1994 | European Pat. Off. . | |
| 1914556 | 3/1970 | Germany . | |
| 2212011 | 11/1972 | Germany . | |
| 143527 | 8/1980 | Germany . | |
| 3941824 | 6/1991 | Germany . | |
| 0530652A2 | 3/1993 | Germany . | |
| 43-19609 | 8/1943 | Japan . | |
| 56-096908 | 8/1981 | Japan . | |
| 59-94614 | 5/1984 | Japan . | |
| 61-47817 | 3/1986 | Japan . | |
| 62-15319 | 1/1987 | Japan . | |
| 63-99312 | 4/1988 | Japan | 425/378.1 |
| 2-269807 | 11/1990 | Japan . | |
| 467348 | 2/1969 | Switzerland . | |
| 1067098 | 1/1984 | U.S.S.R. . | |
| 774814 | 5/1957 | United Kingdom . | |
| 1088240 | 10/1967 | United Kingdom . | |
| 90/02222 | 3/1930 | WIPO . | |
| WO93/19229 | 9/1993 | WIPO . | |

*Primary Examiner*—Jay H. Woo
*Assistant Examiner*—Joseph Leyson
*Attorney, Agent, or Firm*—Oliff & Berridge

[57] ABSTRACT

An apparatus and use thereof for melt spinning multifilament yarns from fiber-forming polymers at windup speeds of at least 2000 m/min is disclosed. The apparatus has a spinnerette, a cooling element for solidifying the filaments, a convergence element for the filaments and a wind-up element and having, at least between the spinnerette and the convergence element, an essentially vertical spinline. The cooling element is a porous tube which is open in the spinning direction and concentric relative to the spinline. The porous tube has disposed downstream of it a further, non-porous tube. It is particularly advantageous for the porous tube to have a length from 10 to 800 mm. It is particularly advantageous for the further, non-porous tube disposed downstream of the porous tube to have a length from 200 to 800 mm.

7 Claims, 3 Drawing Sheets

APPARATUS FOR MELT SPINNING MULTIFILAMENT YARNS

BACKGROUND

The present invention relates to apparatus for melt spinning multifilament yarns from fiber-forming polymers at wind-up speeds of at least 2000 m/min, comprising a spinnerette, a tooling means for solidifying the filaments, a convergence element for the filaments and a wind-up means and having, at least between the spinnerette and the first convergence element, an essentially vertical spinline, wherein the cooling means is a porous tube which is open in the spinning direction and concentric relative to the spinline and wherein air for cooling the filaments is drawn through the porous tube solely by the filaments themselves due to the wind up speed of at least 2,000 m/min, as per U.S. application Ser. No. 07/939,936 filed Sep. 2, 1992, the entire disclosure of which is expressly incorporated herein by reference. The invention also concerns the use of this apparatus for manufacturing polyester filament yarns.

The present invention has for its object to make available the above apparatus for specific purposes, in particular for wind-up speeds of at least 2000 m/min.

SUMMARY OF THE INVENTION

This and other objects are achieved in relation to an apparatus as described above when the porous tube has disposed on its downstream side a further, non-porous tube with or without further porous and/or non-porous tube sections.

A particularly simple way of disposing downstream of the porous tube a further, non-porous tube is to cover a downstream section of the porous tube. For this reason it is advantageous in the apparatus of the invention for the further, non-porous tube to be formed by a covering member disposed on the porous tube. The further, non-porous tube can be followed by further sections of porous and non-porous tubes.

This is because it has been found that the manufacture of multifilament yarns, in particular at wind-up speeds within the range from 2000 to 6000 m/min, is particularly successful when free access of a cooling medium is completely prevented underneath the porous tube. Using such a spinning apparatus it is possible to process virtually any spinnable polymer into multifilament yarn. Especially polyethylene terephthalate, polyamide, nylon-6, nylon-6,6, copolymers thereof and mixtures of these polymers are suited for spinning using the apparatus of the invention.

BRIEF DESCRIPTION OF THE DRAWINGS

The invention will be described in conjunction with the accompanying drawings in which like reference numerals designate like elements and wherein.

DETAILED DESCRIPTION OF PREFERRED EMBODIMENTS

Figure 1:
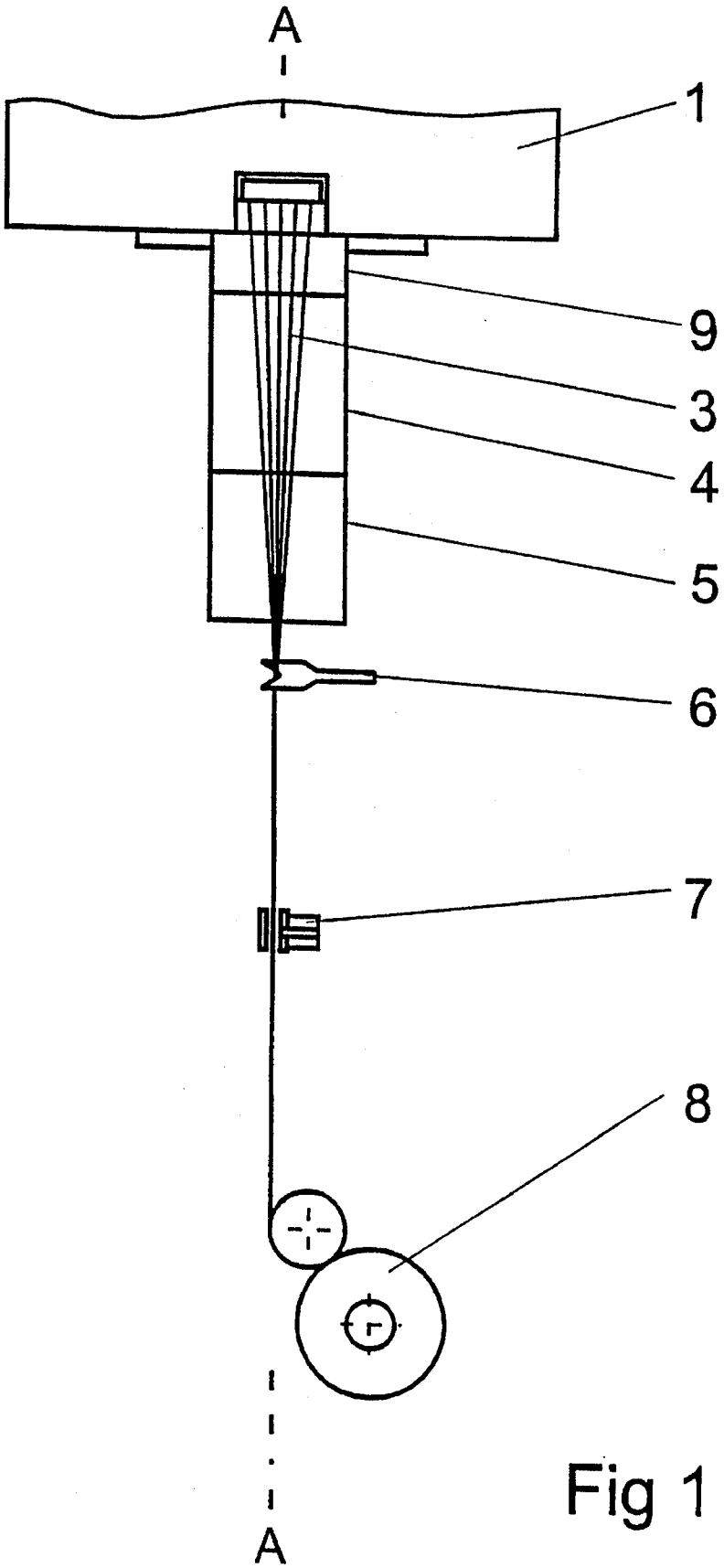
FIG. 1 is a front view of an apparatus according to the invention.

It is particularly advantageous for the porous tube 4 to have a length from 10 to 800 mm. The further, nonporous tube 5 downstream of the porous tube 4 particularly advantageously has a length from 200 to 800 mm. Owing to the simple construction of the cooling means of the apparatus of the invention it is also very simple to adapt the length of the tube to optimal spinning at all times. It is merely necessary to provide a set of porous tubes of differing length, for example within the range from 10 to 800 mm, in which the lengths of the individual tubes differ for example by increments of about 100 mm. However, for further simplification the porous tube may also have a telescopic construction. To manufacture relatively thick monofilaments or filament yarns of higher total linear density, the porous tube 4 used should have a length at the upper end of the above specified length range.

It is fully sufficient for the porous tube 4 together with the downstream non-porous tube 5 to have a constant cross-section in their longitudinal direction, which makes the start-up of spinning with the apparatus particularly simple to accomplish, since the filaments 3 pass through the tubular zone in free fall and can be collected underneath the tube. However, it is also possible to use other tube shapes, for example frustoconical tubes.

The cooling air required for solidifying the filaments is drawn through the porous tube 4 by the filaments 3 themselves, owing to their high speed. Pretreatment of the cooling air is not necessary. Especially in the case of polyester filament yarns, the usual atmospheric conditions in the vicinity of the apparatus of the invention are sufficient. As a result the operating personnel can work on the apparatus of the invention under comfortable conditions. Compared with known apparatus, the apparatus of the invention requires less space, since no ducts are necessary for supplying conditioned air. The start-up of spinning is less wasteful. The apparatus is also notable for particularly low energy requirements, since no conditioning of the cooling air and no further means for influencing the temperature of the yarn are required until the yarn is wound up.

In a particularly preferred embodiment, the spinline is essentially vertical between the spinnerette 1 and wind-up 8.

In the apparatus of the invention it has proved to be particularly advantageous for the porous tube 4 and the downstream non-porous tube 5 to be cylindrical, although the cross-section of the cylinder may have virtually any widely used geometric shape such as, for example, that of a circle, ellipse, octagon or hexagon. It is particularly advantageous for the inner cross-section of the porous tube 4 and of the downstream non-porous tube 5 to have at least approximately the same geometrical shape as the outer contour of the filament bundle 3. This results in a particularly uniform solidification of the individual filaments. It is advantageous here for the distance between the outer contour of the filament bundle and the inner surface of the porous tube 4 at the entry cross-section to be selected in such a way that contact with the tube wall is avoided. A suitable figure for the distance between filament bundle contour and tube wall is from 2 to 40 mm.

In the choice of material for the porous tube it is merely necessary to ensure that the porous tube can be attached directly to the spinnerette 1 and thus that it will not soften at the temperatures prevailing in the spinnerette. Suitable materials for this purpose include but are not limited to metals, especially steel. As for the choice of materials for forming the non-porous tube 5, any suitable material may be used.

The porosity of the porous tubes can in the simplest case be achieved with perforated tubes or else with sintered metals. In principle, any porous tube is suitable whose porosity will, at an airflow rate of 1 m/s, produce a pressure drop from about 3 to 150 Pa, advantageously in the region of 10 Pa for the stated air velocity. However, it is particularly advantageous for the porous tube to be formed of a metal sieve, in which case a metal sieve of 60 mesh is suitable. To stabilize the metal sieve a tube of perforated metal can be arranged inside the metal sieve tube.

The porous tube 4 can be connected directly to the spinnerette 1. However, referring to FIG. 1, it is also possible to connect between the spinnerette 1 and porous tube 4 a device 9 of up to about 300 mm in length which will inhibit the cooling of the filaments and is adjoined by the porous tube.

Inhibition of filament cooling can be effected for example, with means inhibiting the cooling that comprises a hot airstream enveloping the filaments. This ensures a particularly uniform delayed cooling of the filaments. Advantageous results are achieved when the hot air jacket has a temperature which corresponds approximately to the temperature of the spinnerette.

The hot air jacket can be put into effect particularly advantageously when the spinnerette 1 is a multiple spinnerette where the melt is extruded in the center and where there are arranged concentrically around the center one or more orifices through which exits a hot airstream which envelopes the filaments. It is particularly advantageous here for the orifice arranged concentrically around the center to be an annular gap. The use of such spinnerettes for the delayed cooling filament is known per se from DE-A-3 941 824 and EP-A-0 455 897.

Inhibition of filament cooling can also be achieved in a particularly simple manner by a heated tube or in particular an unheated tube.

Figure 2:
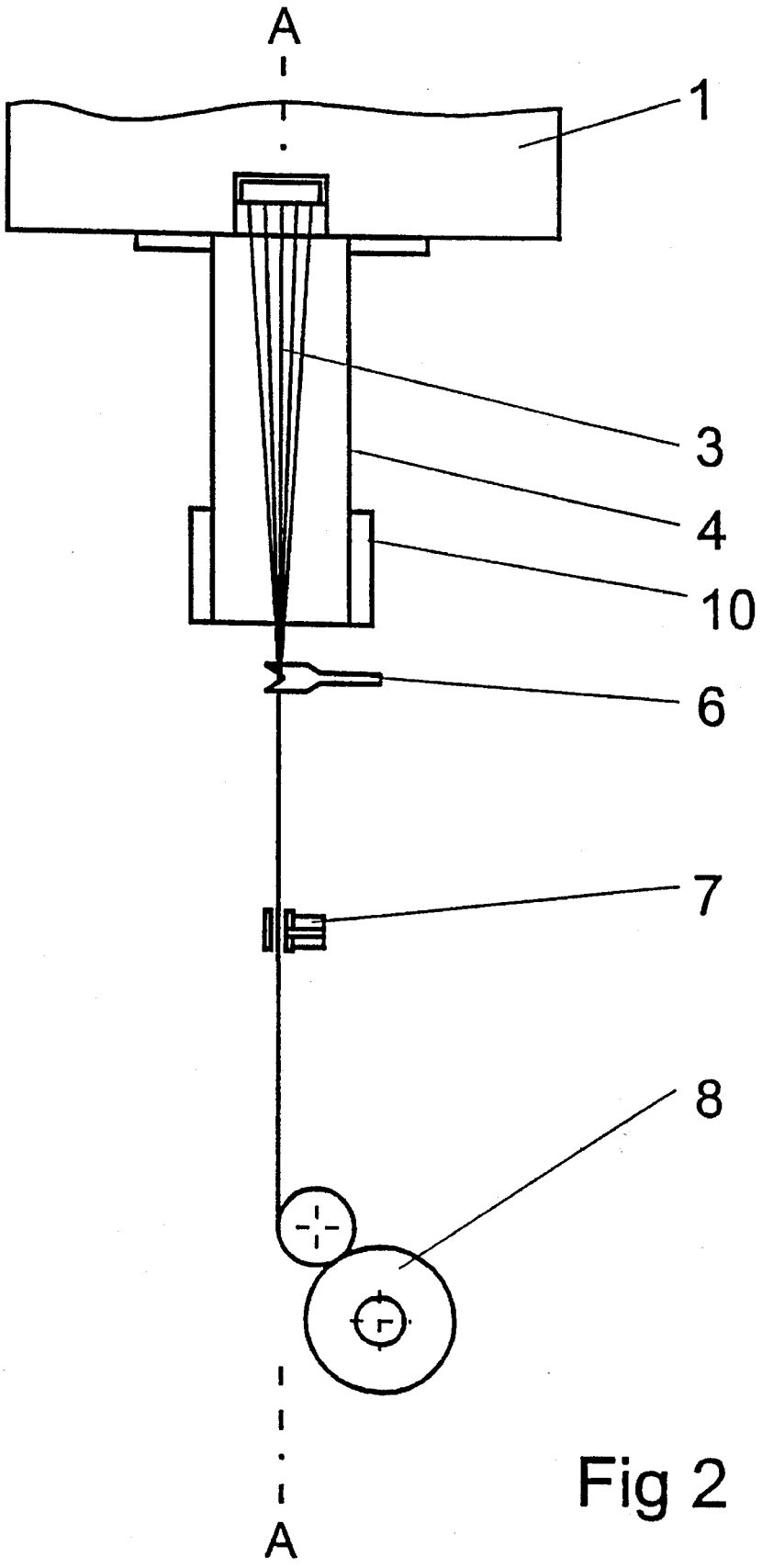
FIG. 2 illustrates another embodiment of the invention.
Figure 3:
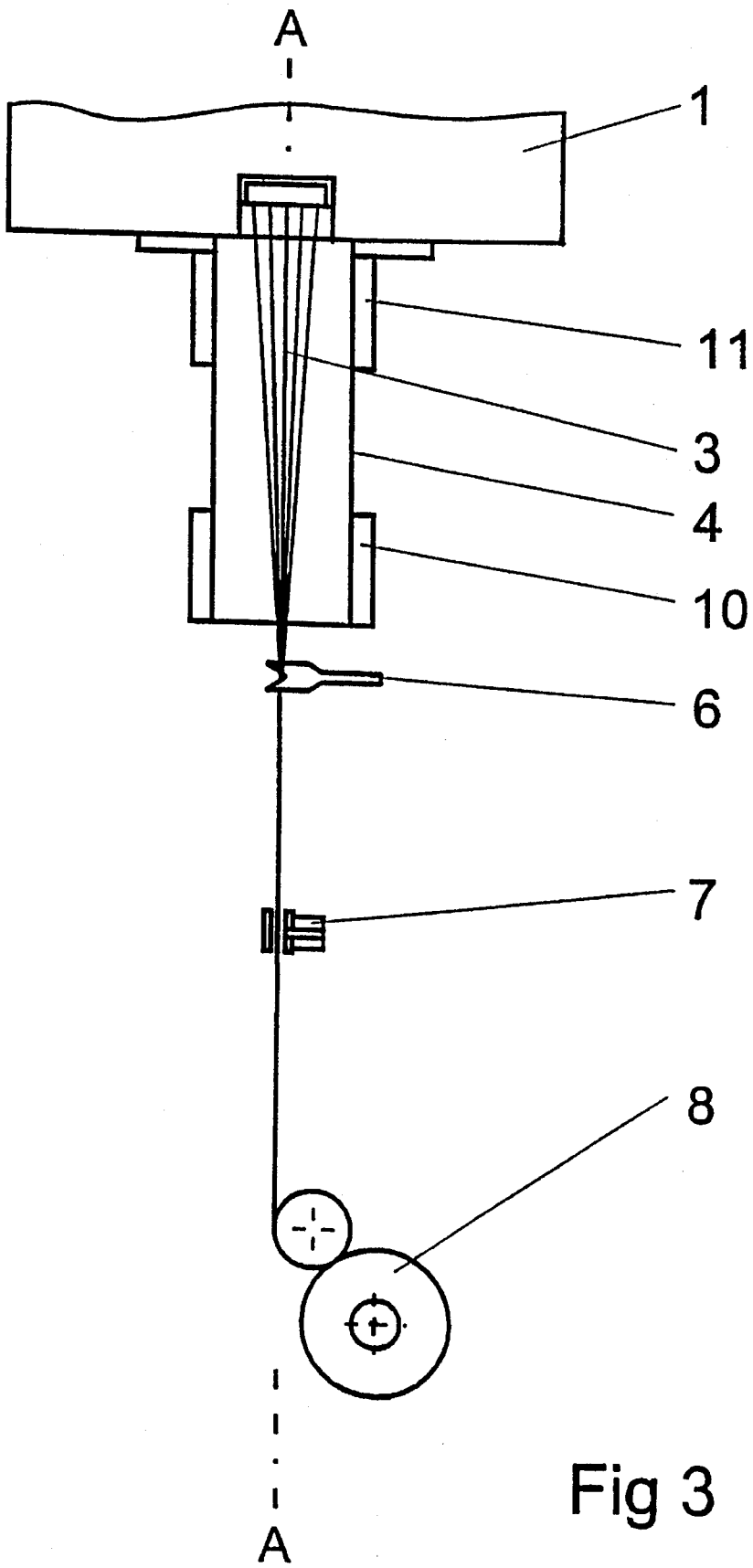
FIG. 3 is a front view of the apparatus of FIG. 2 including an additional covering disposed on the porous tube.

The inhibition of the cooling of the filaments is particularly simple when a part 11 (see FIGS. 2 and 3), up to 300 mm in length, of the end of the porous tube 4 facing the spinnerette 1 is covered. The covered part is preferably situated directly underneath the spinnerette. Additionally, the porous tube 4 can have a downstream portion thereof covered by a covering part 10 to form the downstream non-porous tube (as an alternative to non-porous tube 5).

Inhibition of filament cooling results in delayed cooling of the filaments, as a result of which smooth spinning is promoted, in particular at low filament linear densities.

The apparatus of the invention is particularly advantageous when the convergence element 6 is situated at a distance from 400 to 2000 mm away from the spinnerette 1, but at least about 100 mm below the non-porous tube 5 situated downstream of the porous tube 4. In a simple case the convergence element can be a yarn guide. However, it is particularly advantageous for the convergence element to be a conventional spin finish applicator.

The apparatus of the invention also makes it possible to achieve particularly large distances between spinnerette 1 and wind-up 8, for example up to 9000 mm. The apparatus of the invention is particularly suitable when the wind-up apparatus 8 is situated about 2000 to 4000 mm below the spinnerette 1. At spinning speeds of 6000 m/min or more, for manufacturing FOY (fully oriented yarn), a distance between the spinnerette 1 and the wind-up means 8 of 2000 to 3500 mm, preferably 2400 mm, is most suitable, and in the case of spinning speeds from 2000 to 6000, for manufacturing POY (partially oriented yarn) a distance from 2500 to 3500 mm has proved most suitable, although for the manufacture of yarns having a filament linear density of more than 3 dtex or a total linear density of more than 100 dtex this distance should be extended to as far as 4000 mm. Such an apparatus is notable in particular for its lack of height, as a result of which the operating personnel need work only on one floor. New installation of the apparatus according to the invention thus also results in lower building costs. The apparatus of the invention is particularly notable for reliability.

In most cases a means for entangling the filaments is disposed upstream of the wind-up means 8.

A further reduction in spinning problems is achieved on disposing upstream of the spinnerette 1 a melt line for feeding the polymer melt from an extruder to the spinnerette, in which line there is disposed at least one static mixer. This also has an advantageous influence on the uniformity properties of the spun filament yarns.

It is of advantage for the static mixers to be disposed within the melt line at one or more locations between extruder and spinnerette.

It is particularly advantageous for the static mixers to be disposed directly upstream of a filter pack situated upstream of the spinnerette. It is preferable to ensure that the filter pack upstream of the spinnerette achieves very intensive filtration.

When the apparatus of the invention is used for manufacturing polyester filament yarns at wind-up speeds of up to 10,000 m/min, the yarns obtained as a result exhibit low boiling water and hot air shrinkage values and are particularly uniformly and deeply dyeable. As mentioned earlier, the use of the apparatus has also been found to be particularly advantageous for manufacturing filament yarns from polyethylene terephthalate, polyamide, nylon-6, nylon-6,6, copolymers thereof or mixtures of these polymers. The apparatus is likewise highly suitable in use for manufacturing yarns such as POY or FOY filament yarns at wind-up speeds from 2000 to 8000 m/min with filament linear densities from 0.1 to 6 dtex. Using the apparatus of the invention it is thus also possible to manufacture in a particularly favorable manner microfibers whose linear densities are within the range from about 0.1 to 1.5 dtex, although it is advisable to reduce the wind-up speed and the machine height as the filament linear density of the filament yarns to be produced decreases.

The apparatus of the invention is particularly suitable for manufacturing POY yarns. Preference is therefore also given to using the apparatus of the invention for manufacturing polyester precursor yarn using wind-up speeds from 2000 to 6000 m/min.

We claim:

1. An apparatus for melt spinning multifilament yarn from fiber-forming polymers at a wind-up speed of over 2000 m/min, said apparatus defining a spinning direction and comprising a spinnerette for filaments, a porous tube including a porous tube portion located downstream from said spinnerette for solidifying the filaments, at least one convergence element located downstream from said porous tube portion for the filaments and a wind-up means capable of winding the filaments at a wind-up speed of over 2000 m/min located downstream from said convergence element and having, at least between said spinnerette and a first convergence element of said at least one convergence element, an essentially vertical spinline, wherein said porous tube portion is open in the spinning direction and concentric relative to the spinline and has disposed downstream of it a non-porous tube portion, between said porous tube portion and said first convergence element, further wherein a cooling medium is drawn through said porous tube solely by the filaments themselves due to the wind-up speed of over 2000 m/min to cool and solidify the filaments and wherein a porosity of said porous tube is selected such that the porosity will produce a pressure drop of about 3 to 150 Pa at a cooling medium rate of 1 m/sec, said apparatus having structure inhibiting cooling medium from charging or discharging upstream of said porous tube portion.

2. An apparatus according to claim 1, wherein said non-porous tube portion is formed by a covering disposed on part of said porous tube downstream from said porous tube portion.

3. An apparatus according to claim 1, wherein there is disposed directly underneath the spinnerette a means which inhibits cooling of the filaments and which is adjoined by the porous tube.

4. An apparatus according to claim 3, wherein said means which inhibits cooling is up to 300 mm in length.

5. An apparatus according to claim 1, wherein the porous tube portion has a length from 10 to 800 mm.

6. An apparatus according to claim 1, wherein said non-porous tube portion situated downstream of the porous tube portion has a length from 200 to 800 mm.

7. An apparatus according to claim 1, wherein the wind-up means is capable of winding at a speed up to 10,000 m/min.

* * * * *